United States Patent [19]

Ahonen

[11] Patent Number: 4,624,077

[45] Date of Patent: Nov. 25, 1986

[54] WINDOW INSULATION

[76] Inventor: Pentti Ahonen, 55 Franklin St., Milton, Mass. 02186

[21] Appl. No.: 602,182

[22] Filed: Apr. 19, 1984

Related U.S. Application Data

[63] Continuation of Ser. No. 369,144, Apr. 16, 1982, abandoned.

[51] Int. Cl.[4] ..... E06B 1/04

[52] U.S. Cl. ..... 49/432; 49/415; 49/485; 52/204

[58] Field of Search ..... 52/204, 207, 209; 49/485, 415, 456, 432

[56] References Cited

U.S. PATENT DOCUMENTS

| | | | |
|---|---|---|---|
| 349,877 | 9/1886 | Everett | 49/456 |
| 505,315 | 9/1893 | Kirby | 49/485 |
| 1,100,424 | 6/1914 | Erlinder | 49/415 |
| 1,302,480 | 4/1919 | Soule | 49/415 |
| 1,674,754 | 6/1928 | Wolff | 49/432 |
| 1,796,837 | 3/1931 | Fisher | 49/485 |
| 1,806,018 | 5/1931 | Julien | 49/485 |
| 2,200,548 | 5/1940 | Grady et al. | 49/415 |
| 2,662,255 | 12/1953 | Serley et al. | 49/415 |
| 2,917,788 | 12/1959 | Kunkel | 49/485 |
| 3,086,259 | 4/1963 | Klein | 49/415 |
| 4,257,202 | 3/1981 | Biro | 52/204 |

FOREIGN PATENT DOCUMENTS

| | | | |
|---|---|---|---|
| 29908 | 2/1959 | Finland | 49/489 |
| 189 | of 1893 | United Kingdom | 49/456 |

*Primary Examiner*—Carl D. Friedman
*Assistant Examiner*—Michael Safavi
*Attorney, Agent, or Firm*—Wolf, Greenfield & Sacks

[57] ABSTRACT

An improved technique for providing air tight insulation for a window, particularly a double-hung window, in which there is provided a window panel separating bead for carrying one or more gaskets extending longitudinally of the bead and adapted to be in a folded engaged position for providing an air tight seal between the window panel frame and the bead.

6 Claims, 5 Drawing Figures

WINDOW INSULATION

This application is a continuation of application Ser. No. 369,144, filed Apr. 16, 1982, now abandoned.

BACKGROUND OF THE INVENTION

The present invention relates in general to a technique for insulating windows, particularly adapted for use in the insulation of double hung windows or any similar types of windows in which the window slides in its frame.

A conventional double hung window typically comprises two separate window panels, one normally held in an upper position and the other in a lower position when the window is closed. These window panels are separated by a solid bead or guiding strip that extends vertically and essentially guides the window panels at the same time separating one panel from the other so that they can pass relative to each other as the window is opened either from the top or bottom. However, this separating bead does not provide a tight fit with either of the window panels and thus a substantial amount of heat is lost through the window about this bead.

Accordingly, it is an object of the present invention to provide an improvement in insulating windows, particularly double hung windows so as to provide improved insulation between the window frame or bead and the slidable window panels.

Another object of the present invention is to provide an improved window construction having improved insulating qualities and which thus substantially reduces heat loss through the window.

A further object of the present invention is to provide an improved insulation technique for insulating a window and one which requires relatively simple alteration of the existing window construction so that the concepts of this invention are easily applied to existing windows.

Still another object of the present invention is to provide a kit that can be used in providing improved insulation for existing windows, particularly double hung windows.

SUMMARY OF THE INVENTION

To accomplish the foregoing and other objects of this invention, there is provided a bead that is adapted to replace the conventional solid bead in a window, particularly a double hung window, and in which the improved bead has one or more grooves for excepting a wing-like resilient gasket which extends outwardly from the bead but is sufficiently pliable so as to bend and seal against the side of the window panel frame. The gasket is maintained in this sealing state as the window is slid to open or close along the bead. In accordance with the invention the bead preferably runs the full height of the window casing and has opposed grooves for receiving oppositely disposed gaskets. Each gasket extends a sufficient distance only to engage with its corresponding window panel and thus the gaskets do not extend necessarily the full height of the bead. The gaskets do, however, preferably overlap at the midpoint of the bead. In accordance with the invention the improved window insulation is readily provided in the form of a kit that may comprise the bead, one or more gaskets, and appropriate adhesive means. The adhesive is used to secure the bead into the accommodating groove in the window casement frame.

BRIEF DESCRIPTION OF THE DRAWING

Numerous other objects, features and advantages of the invention will become apparent upon a reading of the following detailed description taken in conjunction with the accompanying drawing, in which.

DETAILED DESCRIPTION OF THE DRAWINGS

Figure 1:
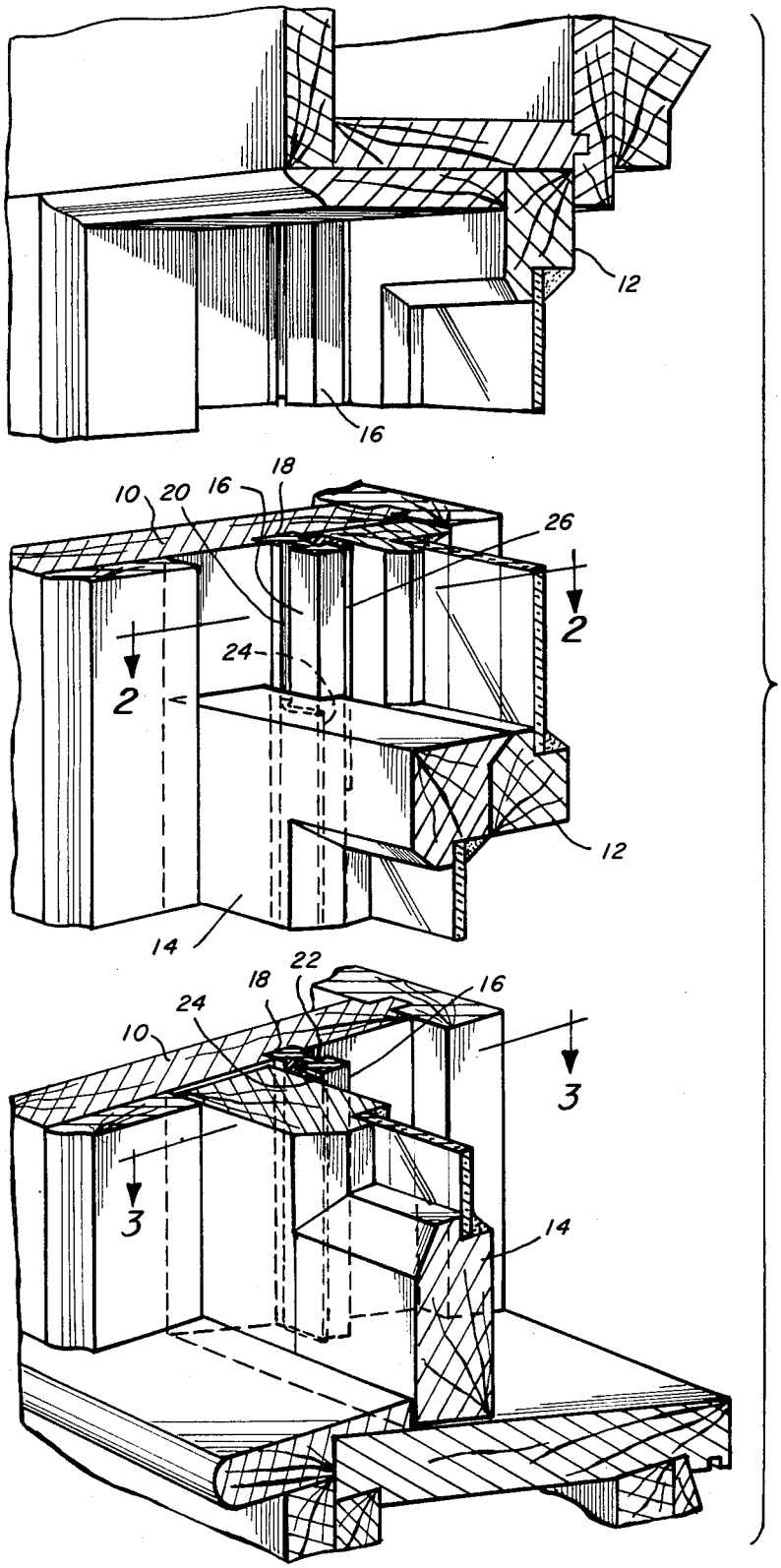
FIG. 1 is a fragmentary side view showing a double hung window including a pair of window panels and employing the insulating, weather proofing gasket of the invention.

Referring now to the drawing, there is shown a double hung window which comprises a window frame 10 in which the window panels 12 and 14 slide. Each of the window panels are a conventional type including a frame and a glass or plexiglass panel.

Each of the window panels 12 and 14 have guide means that form a track in which the window panels are restricted for general vertical movement. In the drawing the window panel 12 is adapted to be the upper panel while the window panel 14 is adapted to be the lower panel. Included in the guide means for the window panels is a center guide strip illustrated in the drawing as a bead 16.

Previously, the bead 16 was a solid wood strip that functioned only as a means for guiding the window panels. However, now, in accordance with the present invention the previous bead can simply be removed and replaced by the bead 16 illustrated in the drawing. The bead 16 has a width adapted to fit directly in the channel 18 in the window frame 10. Such a bead as bead 16 extends vertically, of course, on both sides of the window positioned in channels 18 on respective sides of the window casing or frame 10.

Figure 2:
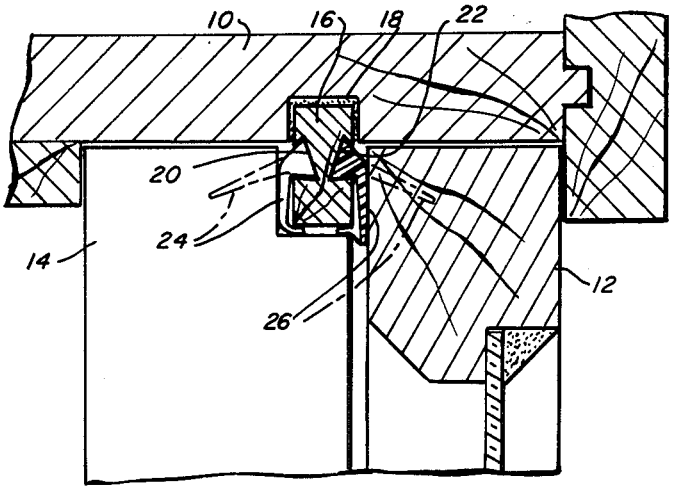
FIG. 2 is a cross-sectional view taken along line 2—2 of FIG. 1.
Figure 3:
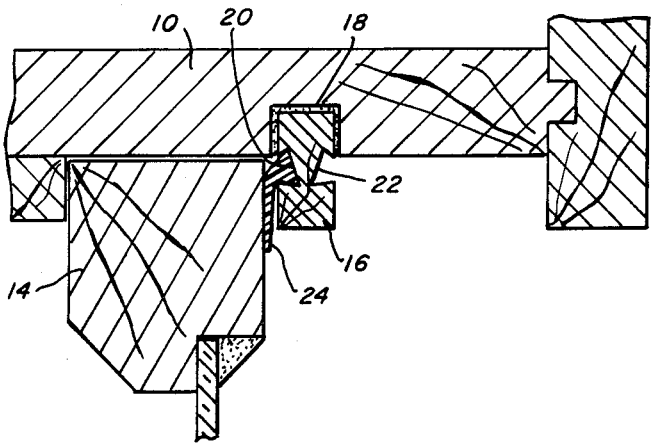
FIG. 3 is a cross-sectional view taken along line 3—3 of FIG. 1.

In the illustration of FIGS. 2 and 3 the bead 16 may be constructed of wood or aluminum and has oppositely disposed grooves 20 and 22 each of which has a substantially shaped cross section and extends longitudinally of the bead. The groove 20 carries a gasket 24 while the groove 22 carries a like gasket 26. Both of these gaskets are made of a resilient material such as rubber, PVC plastic or similar material. In FIG. 2 the bead may have a width of about $\frac{3}{8}$ inch with each of the grooves being about $\frac{1}{8}$ inch deep. Each of the gaskets may, however, extend about $\frac{1}{2}$ inch outwardly from the bead.

The cross-sectional view illustrated FIG. 2 shows the gasket 26 in phanton in its non-folded or non-deflected position extending outwardly of the bead. On the otherhand the cross-sectional view of FIG. 3 shows the gasket 24 folded between the frame of the window panel 12 and the bead 16.

The bead and gasket of the present invention may be provided in a kit form along with an appropriate adhesive. The gaskets may be simply slid into the appropriate grooves in the bead and the weather stripping gaskets may be either glued into the bead or a tight fit may be relied upon between the gasket and bead. For an application in which the bead is used with an existing window, then the old solid bead is removed and the new bead 16 is inserted in the groove 18 and a suitable silicon adhesive or other suitable adhesive is used to glue and suitably secure the bead into the groove in the window frame. As indicated in FIG. 1, one of the gaskets such as gasket 26 extends on one side of the bead down sufficiently so as to always have a portion thereof in engagement with the window panel 12. Similarly, the other oppositely disposed gasket 24 aIso extends sufficiently from the bottom of the bead so that at least a portion of the gasket is always in contact with the window panel 14. The two gaskets preferably have a small overlapping area at the midpoint of the bead. When sold in a kit form the beads may be constructed at a maximum length and can be easily sawed to the desired length corresponding to the window in which it is installed. The installation simply requires the gluing of the bead into the window groove after having inserted the gaskets in the grooves in the bead in the appropriate position as illustrated in FIG. 1. When inserting the bead, the gasket is folded to the position illustrated in FIG. 2 so that the gasket stays in the proper tight position providing an air tight seal between the bead and the window panel frame. Although the gasket is resilient and normally seeks the position shown in FIG. 3, when the window is closed the gasket folds in to the position illustrated in FIG. 2 providing the aforementioned air tight seal between the window and the bead.

Figure 4:
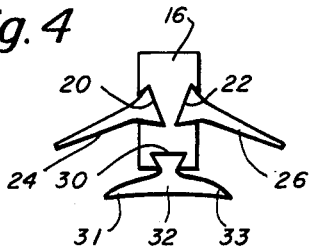
FIG. 4 is a cross-sectional view showing an alternate embodiment bead and gasket.

FIG. 4 is a cross-sectional view illustrating a slightly different embodiment of the invention. Basically, the grooves 20 and 22 and the associated gaskets 24 and 26 are the same as illustrated in FIGS. 2 and 3. However, this embodiment also includes a third groove 30 for carrying a cup-shaped gasket 32. The gasket 32 may be used along with or in place of the gaskets 24 and 26. It is noted that the gasket 32 extends to the side of the beads and in certain installations the opposite sides 31 and 33 of the gasket 32 may be used to provide the engagement with the window panel frame.

Figure 5:
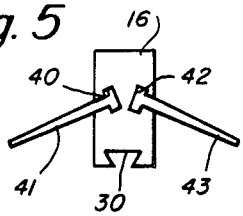
FIG. 5 shows still another alternate embodiment for the bead and gasket.

FIG. 5 shows still another embodiment of the present invention. This embodiment illustrates the bead 16 having a groove 30 similar to the one shown in FIG. 4 but including side grooves that are of a different shape. These are illustrated in FIG. 5 as grooves 40 and 42 for accommodating respective T-shaped gaskets 41 and 43. The gaskets may be made of the same material as discussed previously such as a rubber material or a PVC plastic.

In addition to the gaskets illustrated herein, additional weather stripping may be provided in association with the window such as at the very top of the upper window panel or the very bottom of the lower window panel. In this way an air tight seal is preferably provided around the entire window.

What is claimed is:

1. In a window having a window casement or frame and a pair of window panels each of which includes a window panel frame and glazing, the improvement comprising a bead extending vertically in a groove in the window frame and adapted to partially limit the position of the window panel means as the window panel means slides in the window frame, said bead having a base section disposed in the groove in the window frame and a gasket supporting section which projects inwardly from the window frame, said gasket supporting section only having a pair of longitudinally extending, oppositely disposed grooves on opposite sides thereof for receiving respective resilient deflectable gaskets that extend toward said respective window panel frames, each gasket assuming a folded position deflectable against the window panel frame to provide an air tight seal between the window panel frame and bead, wherein each gasket has a length on the order of about one half the length of the bead, wherein one gasket is disposed on the lower end of the bead and the other gasket is disposed on the upper end of the head with slight overlap between gaskets, said bead grooves each having a dovetail interlocking recess and said gasket having a base adapted to interlock with said recess and a tapered free end thinner than and extending from said base, said free end having a non-deflected position extending toward the panel but disposed at an angle less than a 90° angle to the bead side and further having a deflectable position for providing said air tight seal, said bead grooves being disposed in angular relationship so that the respective gaskets extend in opposite directions but have an angle therebetween in their non-deflected position less than a 180° angle, said bead opposite sides disposed to provide a gap between each side and the window panel frame to enable accommodation of the tapered free ends of the gasket in said gap and extending substantially, in the deflectable position thereof, parallel to the bead sides, one of said window panels having a side-disposed longitudinal vertical recess adjacent the other window panel and adapted to receive said bead, said recess enabling the window panels to be in close side-by-side relationship with one gasket disposed to contact a wall defining the recess and the other gasket disposed to contact the other window panel, said bead having a third groove on a face thereof, and a third gasket received by said third groove, wherein the face carrying the third groove extends substantially normal to the bead surfaces in which the pair of grooves are disposed, wherein said third gasket is supported in a groove with a dove-tail interlock with the third gasket having an outer substantially flat surface, said third gasket being separately and independently supported from said one and another gaskets with the third gasket spaced independently from said one and another gaskets and adapted to contact another wall defining the recess.

2. In a window as set forth in claim 1 wherein the bead is wood.

3. In a window as set forth in claim 1 wherein the bead is metal.

4. In a window as set forth in claim 3 wherein the bead is aluminum.

5. In a window as set forth in claim 1 wherein said gasket is plastic.

6. In a window is set forth in claim 1 wherein said gasket is silicone.

* * * * *